US011242996B2

(12) United States Patent
Stone

(10) Patent No.: US 11,242,996 B2
(45) Date of Patent: Feb. 8, 2022

(54) PORTABLE WARMING ASSEMBLY

(71) Applicant: Calvin Stone, Round Rock, TX (US)

(72) Inventor: Calvin Stone, Round Rock, TX (US)

( * ) Notice: Subject to any disclaimer, the term of this patent is extended or adjusted under 35 U.S.C. 154(b) by 130 days.

(21) Appl. No.: 16/731,731

(22) Filed: Dec. 31, 2019

(65) Prior Publication Data

US 2021/0199302 A1 Jul. 1, 2021

(51) Int. Cl.
*F24C 1/04* (2021.01)
*F24C 1/16* (2006.01)

(52) U.S. Cl.
CPC . *F24C 1/04* (2013.01); *F24C 1/16* (2013.01)

(58) Field of Classification Search
CPC .. F24C 1/04; F24C 1/16; F24B 1/1802; F24B 1/202; A47J 36/30
See application file for complete search history.

(56) References Cited

U.S. PATENT DOCUMENTS 1,446,353 A * 2/1923 Slocum ..... F23B 7/00 431/341
2,036,611 A * 4/1936 Simmons ..... A47J 36/30 126/262
2,488,014 A 11/1949 Higman
3,093,129 A 6/1963 Pickard
3,261,346 A * 7/1966 Powers ..... A47J 36/2477 431/298
3,367,758 A * 2/1968 Henrya ..... A01G 13/06 431/288
3,408,998 A 11/1968 Brancato
3,566,857 A * 3/1971 Price ..... A47J 36/30 126/262
4,174,702 A * 11/1979 Rappaport ..... A61F 7/032 126/208
4,351,314 A * 9/1982 Morton ..... F24B 1/202 126/111
4,475,532 A 10/1984 Woods
4,913,126 A 4/1990 McCall
5,651,356 A * 7/1997 Kaines ..... A47J 27/026 126/204
D390,935 S 2/1998 Bosje
5,759,025 A * 6/1998 Hart ..... A47J 36/26 431/267
5,868,128 A 2/1999 Omar
5,890,483 A * 4/1999 Stevenson ..... F24C 3/14 126/85 R
5,967,769 A * 10/1999 Thompson ..... C10L 5/40 126/25 B (Continued)

*Primary Examiner* — Jorge A Pereiro

(57) ABSTRACT

A portable warming assembly includes a canister and a lid that is removably attachable to the canister for closing the canister. A roll of solid fuel is positionable inside of the canister and the roll of solid fuel is comprised of a combustible material. A container containing a liquid fuel is provided and a pre-determined amount of the liquid fuel is pourable onto the roll of solid fuel when the roll of solid fuel is positioned in the canister. In this way the liquid fuel enhances combustion of the roll of solid fuel. A plurality of rocks is provided and each of the rocks is positionable on top of the roll of solid fuel when the roll of solid fuel is positioned in the canister. Each of the rocks heats the ambient air when the roll of solid fuel and the liquid fuel are burned for heating an interior space.

5 Claims, 4 Drawing Sheets

(56) References Cited

U.S. PATENT DOCUMENTS

| | | | | |
|---|---|---|---|---|
| 6,035,847 | A * | 3/2000 | Paul | C10L 11/02 126/43 |
| 6,213,115 | B1 * | 4/2001 | Anderson | A47J 33/00 126/46 |
| 6,293,274 | B1 * | 9/2001 | Anderson | F24C 1/16 126/46 |
| 6,705,308 | B2 | 3/2004 | Hubscher | |
| 2010/0040990 | A1 * | 2/2010 | Paul | A47J 36/30 431/323 |
| 2014/0060011 | A1 * | 3/2014 | Johnson | F01N 3/0807 60/274 |
| 2014/0093829 | A1 * | 4/2014 | Johnson | F23J 15/02 431/170 |

* cited by examiner

PORTABLE WARMING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to warming devices and more particularly pertains to a new warming device for heating an interior area.

(2) Description of Related Art Including Information Disclosed Under 37 CFR 1.97 and 1.98

The prior art relates to warming devices. The prior art discloses a variety of heating devices that burn a solid fuel for heat, and each of the heating devices has structurally unique features with respect to each other. The solid fuel in every instance comprises a non-absorbent material. The prior art also discloses a variety of heating devices that burn a liquid, or gaseous, fuel for heat. Generally speaking, the liquid, or gaseous, fuel for heat is discretely stored with respect to the heating device, often in a pressurized container. The prior art discloses a heating device that burns a solid fuel and/or a semi-solid fuel. Either the solid fuel or the semi-solid fuel is chosen based on the desired heat output.

BRIEF SUMMARY OF THE INVENTION

An embodiment of the disclosure meets the needs presented above by generally comprising a canister and a lid that is removably attachable to the canister for closing the canister. A roll of solid fuel is positionable inside of the canister and the roll of solid fuel is comprised of a combustible material. A container containing a liquid fuel is provided and a pre-determined amount of the liquid fuel is pourable onto the roll of solid fuel when the roll of solid fuel is positioned in the canister. In this way the liquid fuel enhances combustion of the roll of solid fuel. A plurality of rocks is provided and each of the rocks is positionable on top of the roll of solid fuel when the roll of solid fuel is positioned in the canister. Each of the rocks heats the ambient air when the roll of solid fuel and the liquid fuel are burned for heating an interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
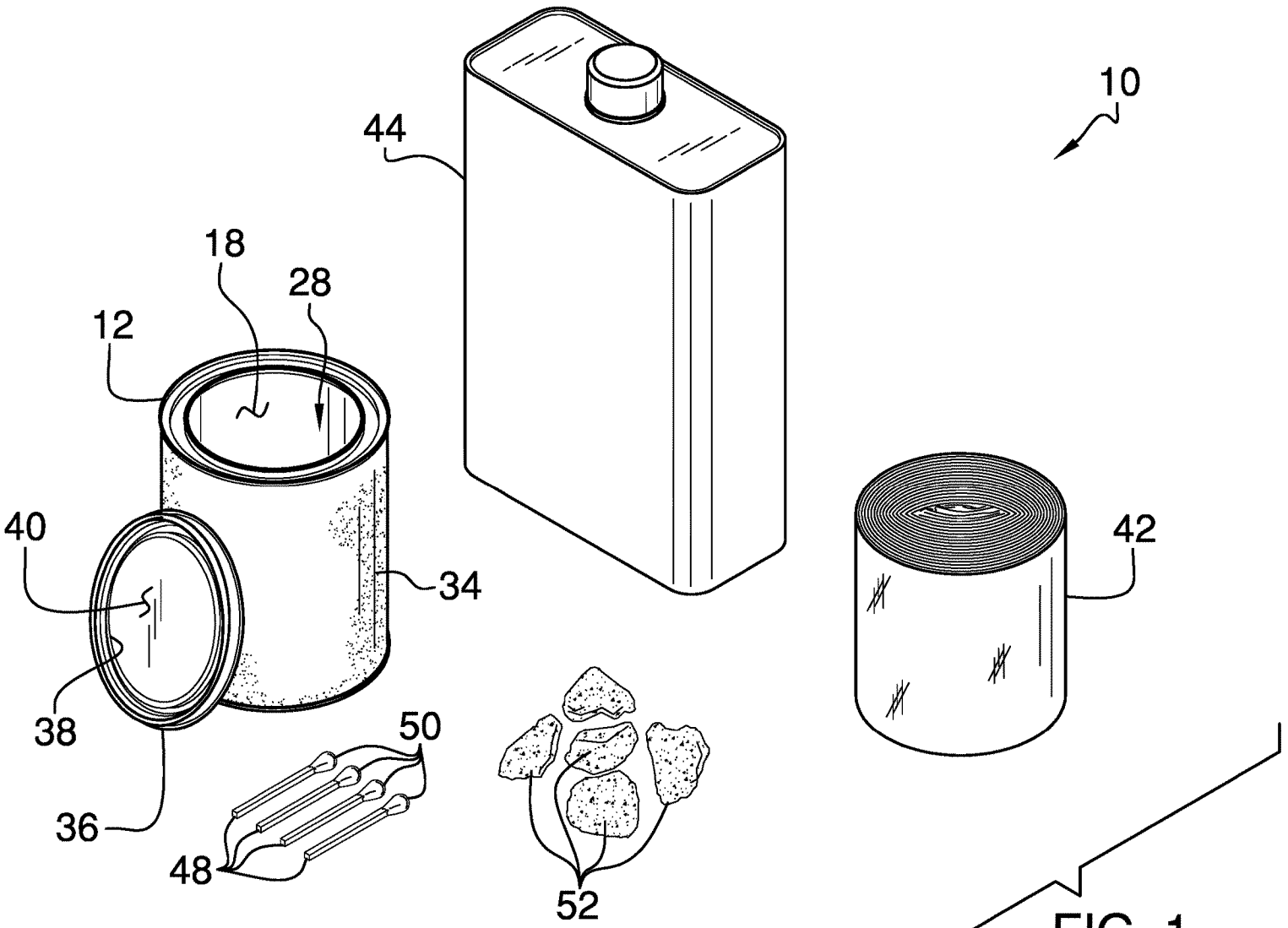
FIG. 1 is a perspective view of a portable warming assembly according to an embodiment of the disclosure.
Figure 2:
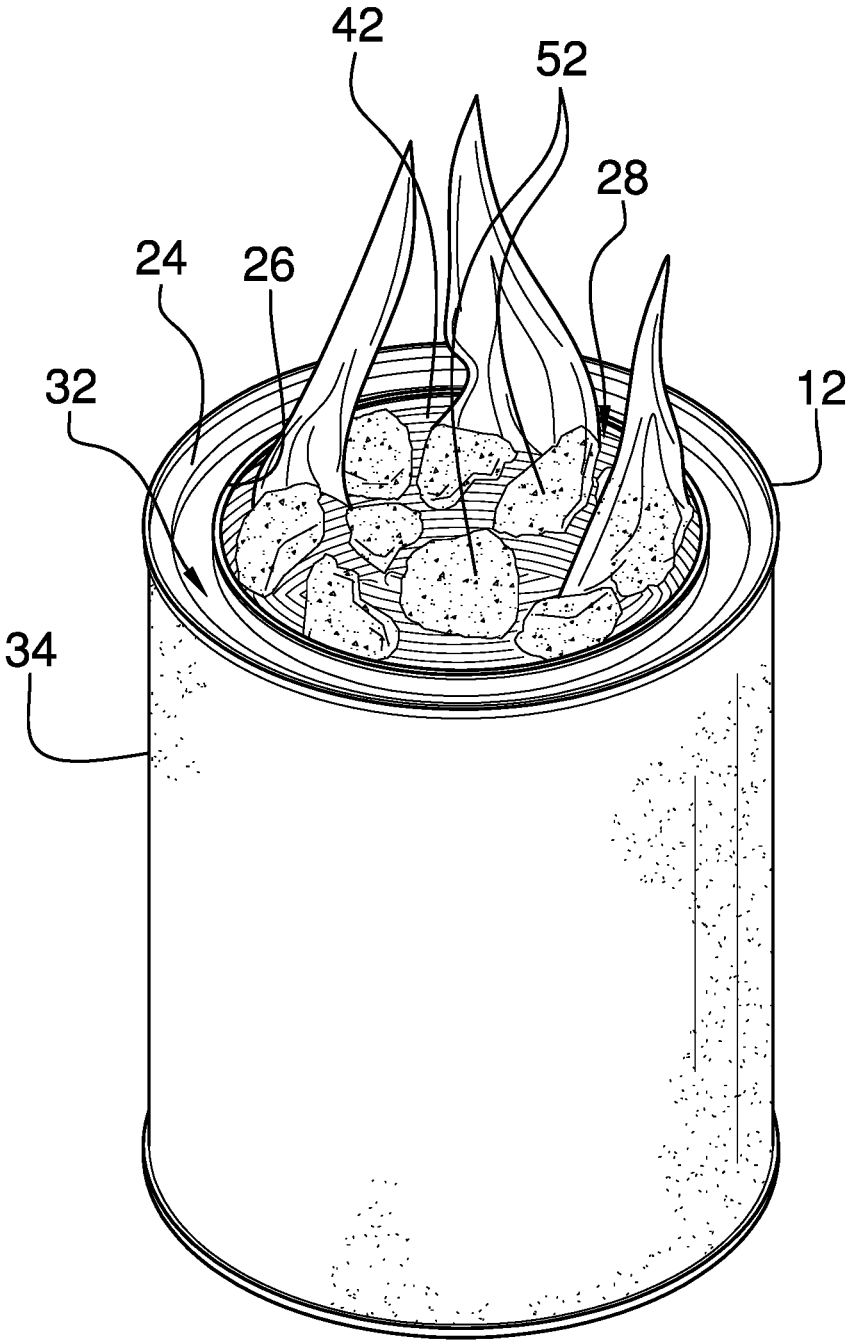
FIG. 2 is a perspective in-use view of an embodiment of the disclosure.
Figure 3:
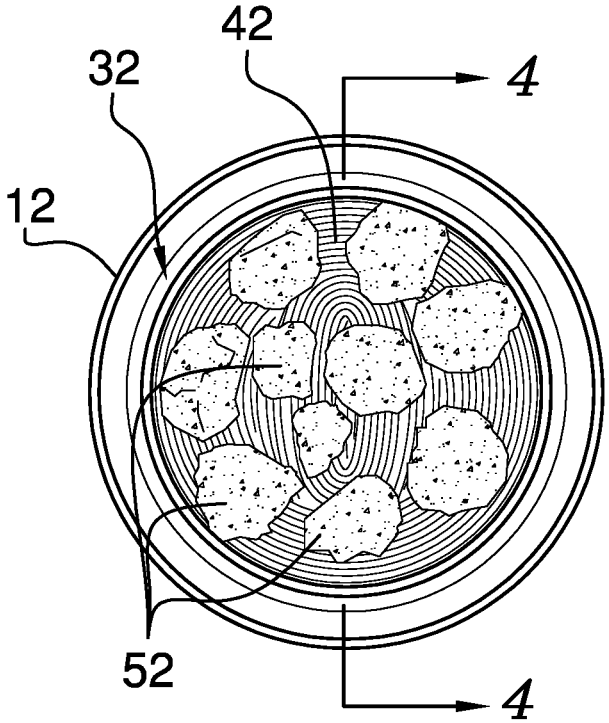
FIG. 3 is a top view of an embodiment of the disclosure showing rocks and a roll of solid fuel in a canister.
Figure 4:
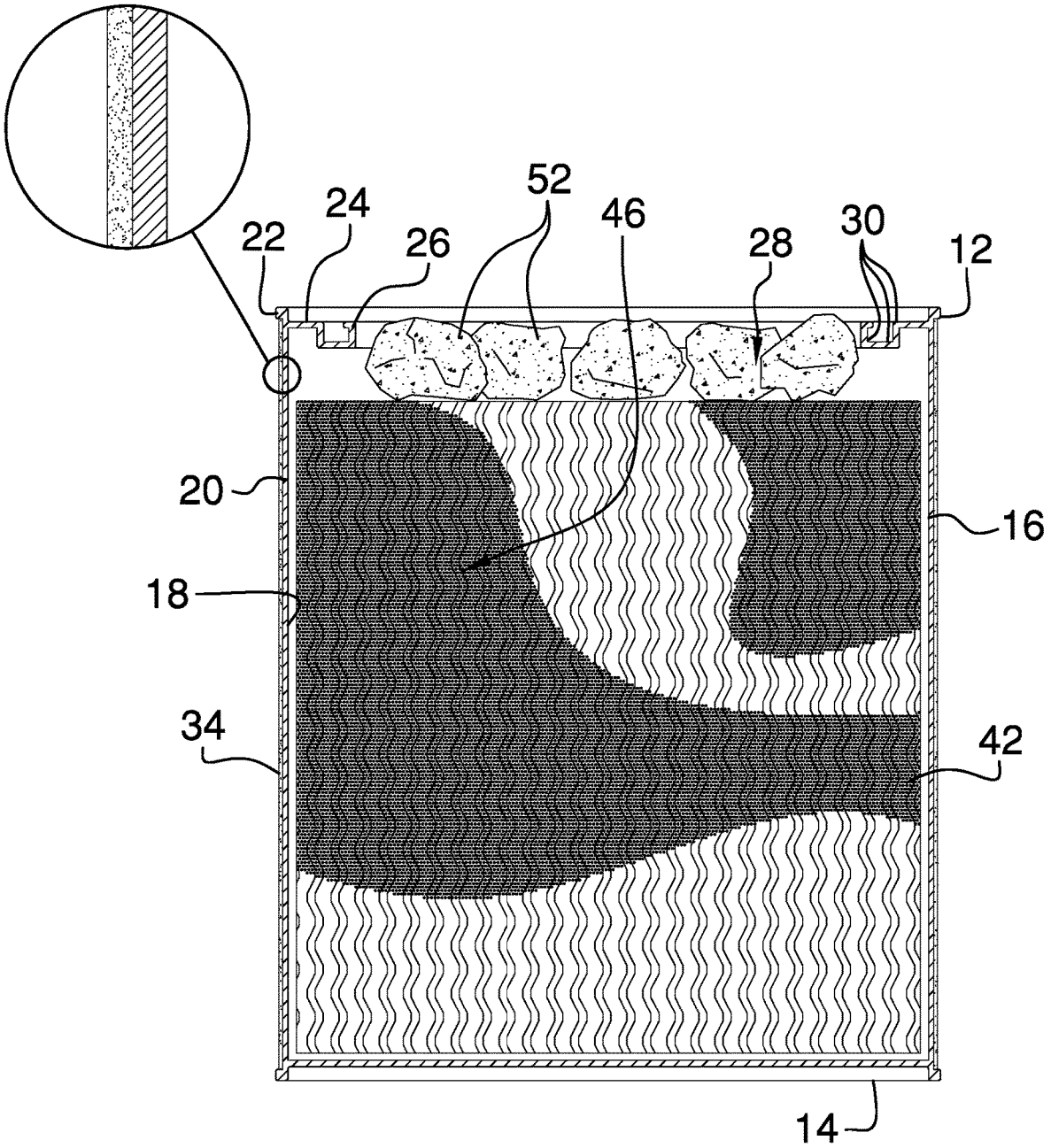
FIG. 4 is a cross sectional view taken along line 4-4 of FIG. 3 of an embodiment of the disclosure.

With reference now to the drawings, and in particular to FIGS. 1 through 4 thereof, a new warming device embodying the principles and concepts of an embodiment of the disclosure and generally designated by the reference numeral 10 will be described.

As best illustrated in FIGS. 1 through 4, the portable warming assembly 10 generally comprises a canister 12 that is comprised of a heat resistant material to resist being damaged by heat. The canister 12 has a bottom wall 14 and an outer wall 16 extending upwardly therefrom; the outer wall 16 has an inner surface 18, an outer surface 20 and an upper threshold 22. The outer surface 20 has a lip 24 extending inwardly therefrom and the lip 24 is aligned with the upper threshold 22 and extends around a full circumference of the inner surface 18. Additionally, the lip 24 has a distal edge 26 with respect to the outer surface 20 to define an opening 28 into an interior of the canister 12. The lip 24 has a series of bends 30 thereon to define a channel 32 extending fully around the lip 24.

An insulation layer 34 is provided that surrounds the canister 12. The insulation layer 34 is comprised of a thermally insulating material to inhibit thermal communication between the canister 12 and ambient air. The insulation layer 34 is bonded to the outer surface 20 of the outer wall 16 and the insulation layer 34 extends between the bottom wall 14 and the upper threshold 22 of the outer wall 16. A lid 36 is removably attachable to the canister 12 for closing the canister 12. The lid 36 has a ring 38 extending downwardly from a bottom surface 40 of the lid 36 and the ring 38 engages the channel 32 in the lip 24 when the lid 36 is positioned on the canister 12. Additionally, the ring 38 forms an air tight seal with the channel 32 for preserving contents of the canister 12.

A roll of solid fuel 42 is provided and the roll of solid fuel 42 is positionable inside of the canister 12. The roll of solid fuel 42 is comprised of a combustible material thereby facilitating the roll of solid fuel 42 to be burned in the canister 12 for producing heat. Additionally, the roll of solid fuel 42 is comprised of a fluid absorbent material. The roll of solid fuel 42 may be a roll of tissue paper, a roll of cotton fiber textile or any other type of suitable material that can absorb fluid and also burn.

A container 44 containing a liquid fuel 46 is included. A pre-determined amount of the liquid fuel 46 is pourable onto the roll of solid fuel 42 when the roll of solid fuel 42 is positioned in the canister 12. Moreover, the liquid fuel 46 is comprised of a combustible material to enhance combustion of the roll of solid fuel 42. The liquid fuel 46 may comprise a combustion accelerant, including but not being limited to, paint thinner, lamp oil, naphtha, or other type of chemical combustion accelerant. A plurality of matches 48 is provided and each of the matches 48 has a striking head 50. The striking head 50 is comprised of a combustible material for igniting the matches 48 to light the roll of solid fuel 42 and the liquid fuel 46 in the canister 12.

A plurality of rocks 52 is provided and each of the rocks 52 is positionable on top of the roll of solid fuel 42 when the roll of solid fuel 42 is positioned in the canister 12. Each of the rocks 52 is comprised of a material having a high thermal mass. In this way each of the rocks 52 can store heat produced when the roll of solid fuel 42 and the liquid fuel 46 are burned. Additionally, each of the rocks 52 is in thermal communication with ambient air to heat the ambient air when the roll of solid fuel 42 and the liquid fuel 46 are burned for heating an interior space. Each of the rocks 52 may comprise lava rocks or other similar type of rock that has a low density and high thermal mass.

In use, the lid 36 is removed from the canister 12, the roll of solid fuel 42 is positioned in the canister 12 and the pre-determined amount of the liquid fuel 46 is poured into the canister 12. In this the liquid fuel 46 is absorbed into the roll of solid fuel 42. The rocks 52 are placed on top of the roll of solid fuel 42 and the matches 48 are employed to ignite the roll of solid fuel 42 and the liquid fuel 46. In this way the rocks 52 are heated by combustion of the roll of solid fuel 42 and the liquid fuel 46. In this way the rocks 52 store, and subsequently radiate, heat while the roll of solid fuel 42 and the liquid fuel 46 are burned. Thus, an interior space, such as the inside of a disabled vehicle or other similar environment, can be heated for the comfort of occupants. Additionally, the canister 12 can be closed with the lid 36 for storing, and preserving, the roll of solid fuel 42, the liquid fuel 46 and the rocks 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable warming assembly being configured to burn a wicking material for heating rocks to subsequently warm an interior space; said assembly comprising:

a canister being comprised of a heat resistant material wherein said canister is configured to resist being damaged by heat, wherein said canister has a bottom wall and an outer wall extending upwardly therefrom, said outer wall having an inner surface, an outer surface, and an upper threshold, said outer surface having a lip extending inwardly therefrom, said lip being aligned with said upper threshold and extending around a full circumference of said inner surface, said lip having a distal edge with respect to said outer surface to define an opening into an interior of said canister, said lip having a series of bends thereon to define a channel extending fully around said lip;

a lid being removably attachable to said canister for closing said canister, wherein said lid has a ring extending downwardly from a bottom surface of said lid, said ring engaging said channel in said lip when said lid is positioned on said canister;

a roll of solid fuel, said roll of solid fuel being positionable inside of said canister, said roll of solid fuel being comprised of a combustible material wherein said roll of solid fuel is configured to be burned in said canister for producing heat, said roll of solid fuel being comprised of a fluid absorbent material;

a container containing liquid fuel, a pre-determined amount of said liquid fuel being pourable onto said roll of solid fuel when said roll of solid fuel is positioned in said canister, said liquid fuel being comprised of a combustible material wherein said liquid fuel is configured to enhance combustion of said roll of solid fuel; and a plurality of rocks, each of said rocks being positionable on top of said roll of solid fuel when said roll of solid fuel is positioned in said canister such that said plurality of rocks is in a single layer on said roll of solid fuel, each of said rocks being sized such that a top of each rock is positioned proximate said upper threshold wherein said lid is attachable to said canister while said roll of solid fuel and said plurality of rocks are positioned in said canister and said plurality of rocks is positioned at said upper threshold when said lid is removed from said canister, each of said rocks being comprised of a material having a high thermal mass wherein each of said rocks is configured to store heat produced when said roll of solid fuel and said liquid fuel are burned, each of said rocks being in thermal communication with ambient air wherein each of said rocks is configured to heat the ambient air when said roll of solid fuel and said liquid fuel are burned for heating an interior space.

2. The assembly according to claim 1, further comprising an insulation layer surrounding said canister, said insulation layer being comprised of a thermally insulating material wherein said insulation layer is configured to inhibit thermal communication between said canister and ambient air.

3. The assembly according to claim 2, wherein said insulation layer is bonded to said outer surface of said outer wall, said insulation layer extending between said bottom wall and said upper threshold of said outer wall.

4. The assembly according to claim 1, further comprising a plurality of matches, each of said matches having a striking head, said striking head being comprised of a combustible material for igniting said matches for lighting said roll of solid fuel and said liquid fuel in said canister.

5. A portable warming assembly being configured to burn a wicking material for heating rocks to subsequently warm an interior space, said assembly comprising:

a canister being comprised of a heat resistant material wherein said canister is configured to resist being damaged by heat, said canister having a bottom wall and an outer wall extending upwardly therefrom, said outer wall having an inner surface, an outer surface, and an upper threshold, said outer surface having a lip extending inwardly therefrom, said lip being aligned with said upper threshold and extending around a full circumference of said inner surface, said lip having a distal edge with respect to said outer surface to define an opening into an interior of said canister, said lip having a series of bends thereon to define a channel extending fully around said lip;

an insulation layer surrounding said canister, said insulation layer being comprised of a thermally insulating material wherein said insulation layer is configured to inhibit thermal communication between said canister and ambient air, said insulation layer being bonded to said outer surface of said outer wall, said insulation layer extending between said bottom wall and said upper threshold of said outer wall;

a lid being removably attachable to said canister for closing said canister, said lid having a ring extending downwardly from a bottom surface of said lid, said ring engaging said channel in said lip when said lid is positioned on said canister;

a roll of solid fuel, said roll of solid fuel being positionable inside of said canister, said roll of solid fuel being comprised of a combustible material wherein said roll of solid fuel is configured to be burned in said canister for producing heat, said roll of solid fuel being comprised of a fluid absorbent material;

a container containing liquid fuel, a pre-determined amount of said liquid fuel being pourable onto said roll of solid fuel when said roll of solid fuel is positioned in said canister, said liquid fuel being comprised of a combustible material wherein said liquid fuel is configured to enhance combustion of said roll of solid fuel;

a plurality of rocks, each of said rocks being positionable on top of said roll of solid fuel when said roll of solid fuel is positioned in said canister such that said plurality of rocks is in a single layer on said roll of solid fuel, each of said rocks being sized such that a top of each rock is positioned proximate said upper threshold wherein said lid is attachable to said canister while said roll of solid fuel and said plurality of rocks are positioned in said canister and said plurality of rocks is positioned at said upper threshold when said lid is removed from said canister, each of said rocks being comprised of a material having a high thermal mass wherein each of said rocks is configured to store heat produced when said roll of solid fuel and said liquid fuel are burned, each of said rocks being in thermal communication with ambient air wherein each of said rocks is configured to heat the ambient air when said roll of solid fuel and said liquid fuel are burned for heating an interior space; and a plurality of matches, each of said matches having a striking head, said striking head being comprised of a combustible material for igniting said matches for lighting said roll of solid fuel and said liquid fuel in said canister.

* * * * *